US006185758B1

(12) United States Patent
Croon et al.

(10) Patent No.: US 6,185,758 B1
(45) Date of Patent: Feb. 13, 2001

(54) DEVICE IN DRAINING GUTTERS

(76) Inventors: Lars Croon, Croongärden, Örnsköldsvik (SE), S-891 92; Bertil Eriksson, Markvägen 1 D, Själevad (SE), S-890 23

( * ) Notice: Under 35 U.S.C. 154(b), the term of this patent shall be extended for 0 days.

(21) Appl. No.: 08/530,254

(22) PCT Filed: Mar. 2, 1994

(86) PCT No.: PCT/SE94/00175

§ 371 Date: Aug. 31, 1995

§ 102(e) Date: Aug. 31, 1995

(87) PCT Pub. No.: WO94/20697

PCT Pub. Date: Sep. 15, 1994

(30) Foreign Application Priority Data

Mar. 4, 1993 (SE) ..... 9300711

(51) Int. Cl.[7] ..... A47K 3/22

(52) U.S. Cl. ..... 4/613; 4/286; 4/288; 4/613; 4/681; 210/163; 210/164; 210/165

(58) Field of Search ..... 4/286, 288, 613, 4/681, 292, 612, 679, 696; 210/163, 164, 165; 137/247, 13, 35, 41

(56) References Cited

U.S. PATENT DOCUMENTS

| | | | | |
|---|---|---|---|---|
| 1,360,630 | | 11/1920 | Fairtrace | 210/164 |
| 2,400,070 | | 5/1946 | Boosey | 210/165 |
| 2,743,786 | | 5/1956 | Boosey | 210/165 |
| 3,495,280 | * | 2/1970 | Galbiati | 4/696 X |
| 3,593,344 | * | 7/1971 | Logsdon | 4/696 X |
| 3,725,964 | * | 4/1973 | Whitsett | 4/679 |
| 4,203,686 | * | 5/1980 | Bowman | 210/164 X |
| 4,263,138 | * | 4/1981 | Kessel | 210/163 |
| 4,742,585 | * | 5/1988 | Logsdon | 4/696 X |

FOREIGN PATENT DOCUMENTS

| | | | | |
|---|---|---|---|---|
| 279501 | | 6/1969 | (AT) . | |
| 586058 | | 11/1966 | (DE) . | |
| 6903939 | | 5/1969 | (DE) . | |
| 7327539 | | 11/1973 | (DE) . | |
| 2507045 | | 9/1976 | (DE) . | |
| 8009493 | | 7/1980 | (DE) . | |
| 3918321 | * | 12/1989 | (DE) | 210/163 |
| 77498 | | 11/1988 | (FI) . | |
| 0085270 | * | 3/1955 | (NO) | 210/163 |
| 120649 | | 1/1948 | (SE) . | |
| 332787 | | 2/1971 | (SE) . | |
| 357995 | | 1/1973 | (SE) . | |
| 7513348 | | 8/1977 | (SE) . | |
| 450781 | | 7/1987 | (SE) . | |
| 457734 | | 1/1989 | (SE) . | |
| 458940 | | 5/1989 | (SE) . | |
| 8001701 | | 8/1980 | (WO) . | |
| 9117324 | * | 11/1991 | (WO) | 4/696 |

* cited by examiner

*Primary Examiner*—Robert M. Fetsuga
(74) *Attorney, Agent, or Firm*—Browdy and Neimark

(57) ABSTRACT

A device in draining gutters comprises a gutter member (11) adapted to be imbedded in a hole in a floor in relation to the surrounding floor, connectable to a conduit (6) for draining water, said member being adapted to receive water, and an arrangement for sealing the floor covering (8) in relation to the gutter member, for preventing water from finding its way between the latters. This sealing arrangement has means (23, 24, 25) aranged to seal against the floor covering (8) by bearing on the latter from above around an upper water receiving opening (32) of the gutter member.

22 Claims, 2 Drawing Sheets

DEVICE IN DRAINING GUTTERS

THE FIELD OF THE INVENTION AND PRIOR ART

The present invention refers to a device for draining gutters.

Such draining gutters are arranged in different kinds of spaces for wet conditions, such as e.g. bathrooms and shower rooms, to receive and drain water, such as bath water and shower water, The floor in these rooms is provided with a wet room isolation element in the form of a waterproof floor covering, which can form the very floor covering when it, for instance, is some kind of plastic carpet or can be coated with the very floor covering, if the room for wet conditions is provided with clinker as the real floor covering. With the expression "floor covering" hereinafter and in the claims, is though referred to said waterproof wet room isolation element, which thus can form the very floor surface or not.

In draining gutters of this sort it is of the uttermost importance that a seal is arranged, which seal prevents the risk for the occurrance of water damages on floor frame works, the very floor covering or other adjacent building elements. Up to this date, such sealings has been obtained as the floor covering has been cut up in the area of the gutter member, so that sections thereof have been possible to fold down into the gutter member and have been applied to the upper sections of the side wall of the latter, for sealing the floor covering to the gutter member. Thereby, it has been necessary to heat the floor covering to remove the tendencies of the sections that have been folded downwards into the gutter member to creep up from the gutter member, and to form these sections so that they bear tightly on the sidewall of the gutter member. To obtain the desired sealing between the gutter member and the floor covering sections folded downwards a clamp ring has been arranged, said clamp ring being insertable from above into the opening of the gutter member, and said clamp ring executing radial forces against the floor covering sections folded downwards when in inserted position.

However, these earlier known devices in draining gutters present important drawbacks. Even when using the above mentioned-procedure for heating the floor covering, which procedure in itself is complicated and forms a considerable drawback, some remaining strains will still exist in said floor covering sections, said strains lending said sections a tendency to strive upwards from the gutter member. In time this unavoidably leads to certain deformations of the floor covering material, such as bulges and the like, through which water that exists in the gutter member is able to, mostly through capillary action, find its way into behind the floor covering sections and in this way cause damages caused by damp on the bottom side of the floor covering, the result of which may be that the complete floor covering of the room for wet conditions must be, substituted, or even on surrounding sections in floor frameworks or other building elements, which might lead to substantially more far-reaching and costlier sanitation operations.

BRIEF DESCRIPTION OF THE INVENTION

The object of the present invention is to provide a device in draining gutters, which sets aside the above mentioned drawbacks of previously known such devices and thereby eliminates the risks for damages caused by damp originating from the draining gutter in a room for wet conditions provided with such a gutter.

According to the invention, the object is obtained by providing the sealing arrangement of the device with means arranged to seal against the floor covering by bearing on said floor covering from above around an upper water receiving opening of the gutter member. Thanks to the sealing means being arranged to bear on the floor covering from above it is no longer necessary to fold said covering down into the gutter member, whereby the floor covering sections located nearest to the gutter member won't have any noticeable inherent movement or deforming forces.

According to a preferred embodiment of the invention the device is provided with members for urging said sealing means towards the floor covering. Hereby, by means of said sealing means, a constantly good and reliable sealing is obtained.

According to another advantageous embodiment of the invention the device is also characterised in that it comprises a ring adapted to surround said opening and, beneath itself, receive the floor covering sections located nearest to the opening, said urging member being arranged to accomplish a force on the ring, said force being directed generally vertically downwards. In this way water located on the floor is thus effectively prevented from flowing beyond the sealing means and reaching the region of the gutter member in any other location than through the upper opening of the gutter member.

According to another, very advantageous embodiment of the invention the gutter member is designed to be releasably connectable to said conduit and arranged to be removable from the floor after removal of the force of said urging members. Hereby it will thus be possible to remove the gutter member and check its condition at suitable times, especially the look of its different seals.

According to yet another embodiment of the invention the device comprises a container-like insert that defines the hole in a floor and, apart from having an opening towards said conduit, is waterproof and adapted to be fixed in relation to the surrounding floor, the gutter member having a smaller dimension laterally and as to depth than the insert and being arranged to form a space between itself and the insert. Hereby is obtained that even if the very improbable would occur, namely that water passes said sealing means, this water will arrive in the space between the gutter member and said waterproof insert, so that thereby no water damage can appear. Thereby the bottom of the insert is preferably provided with a hole which immediately indicates such a leakage by, in a suitable way, draining t he water that comes into the s pace, so that suitable measures for stopping the leakage immediately can be taken.

The invention also refers to a method accomplishing a draining gutter in a room for wet conditions. By this method the accomplishment of a draining gutter in a room for wet conditions is considerably facilitated in relation to previously known such methods as the floor-layer only has to lay the floor surface, and applying the hole therein for said draining gutter can wait until it is time for application of heating, water and sanitation connections in the room for wet conditions, as this easily can be done by a non-professional in the floor-laying field. From this follows that the gutter member doesn't need to be arranged in place before the final finishing of the room for wet conditions through the applying of said heating, water and sanitation connections, so that the risks for the gutter member to get broken or hurt in any other way in a building work place are considerably reduced.

Further advantages and advantageous characteristics of the invention will appear from the following description and the rest of the enclosed claims.

BRIEF DESCRIPTION OF THE DRAWINGS

Below, a preferred embodiment of the invention, which is stated as an example, is described with reference to the enclosed drawings, in which.

DETAILED DESCRIPTION OF A PREFERRED EMBODIMENT OF THE INVENTION

Figure 1:
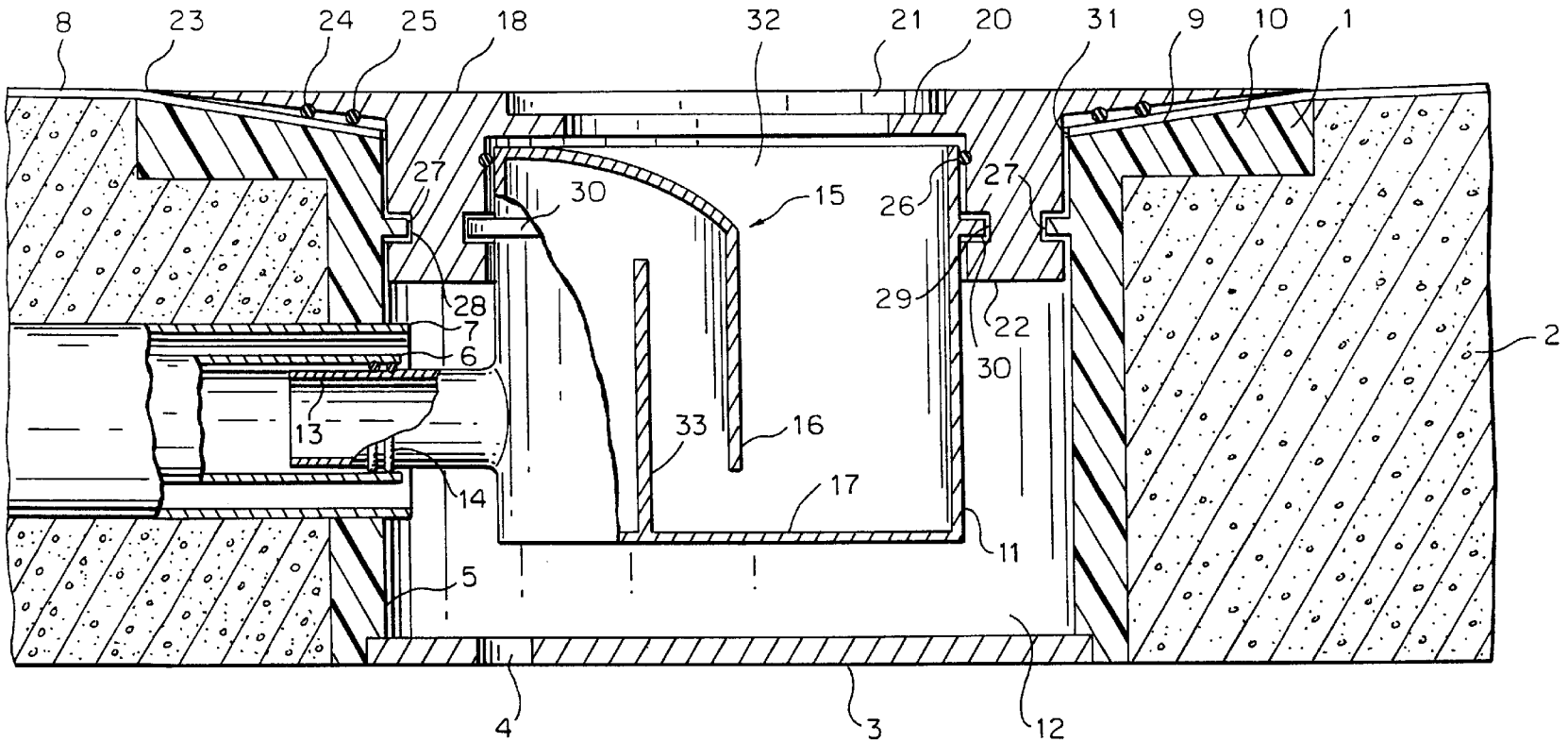
FIG. 1 is a vertical section through a device in a draining gutter according to a preferred embodiment of the invention, said device being arranged in place in a floor and certain parts having been broken away for the sake of illustration.
Figure 2:
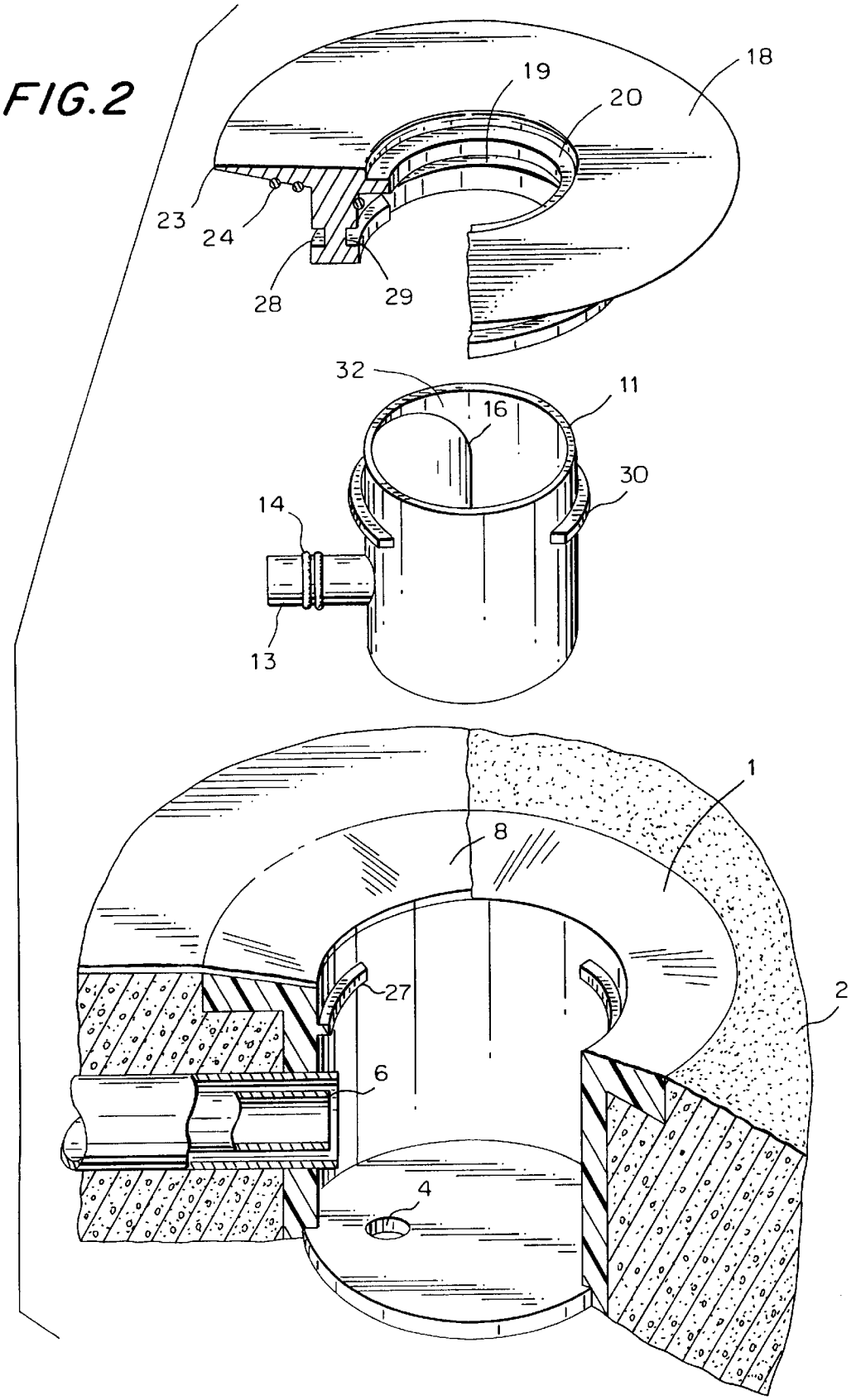
FIG. 2 is an exploded, partially sectioned perspective view illustrating the design of the different components of the device of FIG. 1.

The device has a container-like insert 1, which defines a hole for a draining gutter, the insert preferably being of a plastic material and being waterproof and adapted to be fixed in relation to the surrounding floor or the floor frame work 2 in connection to the applying thereof to the building in question, the applying of the insert for instance taking place by holding said insert in a requested position and thereafter filling concrete around said insert or fixing it through a connection with adjacent floor frames or the like. The bottom of the insert 1 is formed by a plate 3 which is possible to separate from said insert, which plate is mounted in place simultaneously with the rest of the insert and has a through hole 4, the function of which will be described later.

The insert 1 presents an opening in its side wall 5 for receiving a pipe 6 for draining water that flows down into the draining gutter. A tube 7, which is concentrically arranged in relation to the pipe 6 and also opens in the insert 1, is arranged to take care of water that is possibly leaking out of the pipe 6 and remove it to a shaft in a way known per se.

The floor is provided with a floor covering 8, for instance a plastic carpet or some other wet room isolation element, said covering extending to the upper limitation of the side wall of the insert 1 and being cut-off there. The floor covering sections 9 located nearest to the gutter opening are adapted to bear on the surrounding upper insert section 10, which is connected to the sidewall of the insert and extends radially outwards and makes an angle with the floor covering and the floor associated therewith by making a larger angle in relation to the horizontal than does said covering, so that the floor covering initially slopes slightly until it reaches the insert section 10 and after that slopes somewhat more towards the inside of the insert section. Thereby, the insert section makes an angle of between 1° and 30°, preferably between 3° and 15° with the horizontal. The conical surface constitutes means for the floor covering 8 to extend over the conical surface to a region 31 (FIG. 1).

The device further presents a specific gutter member 11, which is adapted to be arranged immersed into the insert 1 and, thereby, in relation to the surrounding floor and to receive water flowing down thereinto to drain this water via the pipe 6. The gutter member 11 is formed by a generally cylindrical container, preferably made of plastic material or stainless steel, which container has smaller dimensions laterally and as to depth than the insert 1, so that, when arranging the gutter member 11 in the insert in the way shown in FIG. 1, a space 12 is formed between these. In its side wall the gutter member 11 presents a tube stump 13 that has an outer diameter which is slightly smaller than the inner diameter of the pipe 6 and on the outside of which surrounding sealing members 14 in the form of conventional O-rings are arranged to form an axial seal between the pipe 6 and the tube stump 13 when the gutter member is brought down into the insert and the tube stump 13 is inserted into the pipe 6, so that water flowing inside the pipe 6 is prevented from reaching the space 12 via the outside of the tube stump 13. The tube stump 13 and sealing members 14 constitute a means for draining. Further, the gutter member 11, in a conventional way, presents a water seal 15, which is formed by a first wall section 16, which extends from a point in the area of the upper edge of the gutter member and downwards, to be ended at a certain distance above the bottom 17 of the gutter member. The first wall section 16 extends continuously between opposite side wall sections of the gutter member. Between these opposite side wall sections of the gutter member a second wall section 33 extends closer to the tube stump 13 and extends from the bottom 17 and up to a substantial vertical overlapping of the first wall section. Hereby, in a conventional way, a water seal is obtained as the water level existing in the gutter member always will be located above the lower limitation of the first wall section 16 and accomplish a delimitation of the air that emerges in the upper opening of the gutter member in relation to water leading sections located downstream the water seal.

The device further comprises a ring 18 constituting means for connecting, with a central opening 19 with a lowered support section 20 for receiving a cutter sieve or grating 21 laying thereon, said section 20 extending around said opening 19. The ring 18 is preferably made of sheet material, aluminium or stainless steel and presents a surrounding section 22 that extends axially and defines an opening which has a diameter which is larger than the outer diameter of the gutter member 11, so that the ring 18 can be axially brought down into the insert 1 with its axial sections while radially surrounding the upper side wall sections of the gutter member 11. The ring 18 acutes continuously radially outwards into a point section 23 that presents a generally horizontal upper surface and that has a point angle which is slightly smaller than the angle made by the upper surface of the upper insert section 10 and the horizontal, On the bottom side of the ring 18 two surrounding sealing means 24, 25, in the form of conventional O-rings, made of elastic compressible material are arranged, The ring also presents a second sealing means 26, also this one an O-ring, which bears on the radially inwards turned wall of the axial section 22.

In its upper region the side wall 5 of the insert 1 presents first engagement members 27 in the form of lists, which are two as to the number and are arranged opposite to each other and to extend in the circumferential direction over an angle distance of, for instance, scantily 900. The grooves 28 are designed to be able to receive the lists 27 therein. On the radially inwards directed part of the axial section 22 of the ring third engagement members 29, in the form of grooves, are designed in a corresponding way, and on the outer wall of the gutter member fourth engagement members 30, in the form of lists, are arranged and can be brought into engagement with each other.

The ring 18 is adapted to co-operate with the insert 1 and the gutter member 11 in the following way to obtain a required seal between the gutter member and the floor covering that surrounds it, which covering does not reach all the way to the opening 32 of the gutter member and therefor not even bears on the gutter member from above: when the gutter member 11 has been brought into the pipe 6 by means of the tube stump 13 so that the gutter member is centrally located in the insert 1, the ring 18 is brought downwards in axial direction and with the axial section between the sidewall 5 of the insert and the gutter member 11, the ring 18 being held in such a turned way that the grooves arranged therein are circumferentially displaced in relation to the lists on the gutter member and the insert, so that the axial section can be pushed beyond these lists to a position in which the lists in question are located in front of the grooves. When this position has been reached, the ring 18 is turned so that the lists 27 and 30 are being brought into the grooves 28 and 29 respectively. After that, the turning of the ring 18 in relation to the insert 1 is continued while said lists are running in the grooves in such a direction that the lists of the insert, via the grooves 28, affect the ring 18 in an axial direction downwards, whereby the sealing means 24 and 25 will be pressed into a pre-strained bearing on the floor covering sections 9 located under said means. At the same time, the point of the point section 23 of the ring is pressed against the floor covering 9 and seals in relation to the latter. The second sealing means 26 will be slightly compressed between the outer wall of the gutter member and the axial section of the ring and will thereby prevent water coming down from the sieve from finding its way to the outside of the gutter member. The lists 27 will thus force the ring 18 into a pre-strained position, while it isn't meant that any transfer of force shall take place between the ring 18 and the gutter member 11 via the grooves 29 and the lists 30, but these members only are adapted to assist the tube stump 13 in holding the gutter member in place in the insert.

Thus, the lists 27 and grooves 28 are first and second engagement members and constitute means for the ring 18 and the insert 1 to be brought into engagement, means to permit the ring to be turned relative to the insert 1, and means to assist in holding the ring 18 and insert 1 together. Similarly, the lists 30 and grooves 29 are third and fourth engagement members and constitute means for the gutter member 11 and the ring 18 to be brought into engagement, means to permit the ring to be turned relative to the gutter member 11, and means to assist in holding the gutter member 11 and the ring 18 together.

The screwing of the ring 18 will thus lead to a movement in the axial direction of said ring so that the point of the point section 23 of the ring will be pressed to a pre-strained bearing on the floor covering and thereby function as a sealing means between the ring 18 and the floor covering and prevent water flowing on the floor covering towards the gutter-from finding its way down under the ring 18 and thereby having to take the way via the sieve 21 of the gutter and down into the gutter member without getting in the nearness of the location 31 where the floor covering ends. Also the surrounding sealing means 24 and 25 are pressed to a pre-strained bearing on the floor covering sections 9 and serve as an extra security as they, if water actually would trickle between the point section 23 and the floor covering, would prevent this water from getting any further than to these sealing means and thus force said water to find its way to the gutter member via the sieve 21 and not to get in the nearness of the location 31. Would the improbable yet occur, that water at any place, for instance at the second sealing means 26, finds its way between the floor covering 8 and the gutter member 11 this water will reach the space 12 and leave this through the hole 4, so that it will immediately be indicated that a leakage exists in the draining gutter, after which something can be done about this leakage in good time before any real damage has been caused. Thus, the hole 4 constitutes one means for in dictating leakage. Even when omitting said leakage indicating hole, water leaking into the space 12 would never be able to rise to the area of the end of the floor covering sections 9 (location 31), as this water never would reach higher than to the tube 7 leading to the shaft without being led away to the shaft via this tube. Thus, the tube 7 constitutes means for removing water. Additionally, the floor covering 8, at the location 31 of the ending thereof, bears on the upper insert section 10 without any inherent tendencies as to deformation, so that the sealing means 24, will make the floor covering seal complete against this insert section 10. Thus, the floor covering doesn't present any section that reaches into or over the opening of the gutter member, and here it even ends at a distance from the very gutter member opening and thereby it is out of question that water reaching the gutter member shall be able to reach the floor covering edge and creep under this, for instance by means of capillary action.

The device according to the invention makes it possible to remove the gutter member 11 for an examination by turning the ring 18 in a direction opposite to the tightening direction, to the position in which the lists and grooves go free in relation to each other, after which the ring 18 can be lifted in an axial direction upwards in relation to the insert 1 and the gutter member 11. The fixing of the ring 18 to the insert 1 thus forms a sort of progressive bayonet fixing. When the ring 18 has been lifted away the tube stump 13 and the gutter member 11 can easily be drawn out of the pipe 6 and after that the gutter member is taken away from the insert defining the hole in a floor. Thanks to the possibility of taking the gutter member away, the latter can be taken up for the chance of seats, with regular intervals, if that is judged to be necessary, and if the gutter member by any reason would turn out to be leaking during such an examination it can be replaced by a new gutter member.

During the application of the draining gutter described above in a space for wet conditions one proceeds preferably in the following way: in connection to the application of the floor frameworks 2 the insert 1 is fixed in relation to the former in the position in which one later wishes to arrange the draining gutter. When the floor covering later is laid it is laid over the whole floor by a carpet-layer so that it also covers the upper opening of the insert. Later, when it is time to apply the heating, water and sanitation connections in the room for wet conditions the plumber detects the location of the upper edge of the side wall of the insert and there he cuts the floor covering away. Then he inserts the gutter member in place and applies the ring 18 and tightens the latter. After this the draining gutter is installed. When laying a clinker, the carpet layer, immediately after having applied the floor covering formed by a wet room isolation element, can put said clinker on top of the latter as far as to until the area of the peripheral, upper edge of the insert 1, so that the ring 18 later can be brought in its place without knocking against the clinker plates.

Of course, the invention is not in any way limited to the preferred embodiment described above, but a lot of possibilities as to modifications thereof should be obvious for the one skilled in the art without the embodiment diverging from the scope of the invention by that reason.

For instance, it would be possible to design the different engagement members, especially between the insert and the ring, in a number of different ways, for instance to replace male engagement members with female ones and vice versa, Likewise, these members could have another extent than has been shown in the figures and yet see to that the insert forces the ring in axial direction. It would also be possible to accomplish the forcing of the ring upon the sealing means against the floor covering in another way than by turning of the ring, for instance by some sort of screw union, even if the latter example would be somewhat more complicated than the one illustrated above. In the latter case it would be imaginable to possibly arrange the ring in question in one piece with the gutter member, so that sections of the very gutter member will directly press the sealing means against the floor covering, The conduit from the gutter member could, of course, be connected thereto in a different way, for instance lead downwards from the bottom of the gutter member.

The engagement members could also be formed by several turns of co-operating screw threads.

Instead of the O-rings bearing on the floor covering silicon glue or the like applied thereon could for instance be used as a sealing means and the gutter member could be arranged more permanently in the hole in a floor.

Even if water is mentioned above as well as in the claims, the reception of any other liquid in such a draining gutter is of course completely equivalent.

With the patent claim definition "bearing on from above" is only meant that the vector of the bearing force has a vertical component which is larger than the horizontal one.

What is claimed is:

1. A draining device for a hole in a floor (2) with a floor covering (8), the device comprising:

(A) a waterproof and water-containing insert (1) adapted to be fixed relative to the floor in the hole, the insert including a side opening in a side wall (5) thereof;

(B) a waterproof and water-containing gutter member (11) having a water-receiving upper opening (32) and lateral and depth dimensions smaller than an interior of the insert, whereby the gutter member and the insert comprise means to define a space (12) therebetween;

(C) a conduit disposed to drain from the insert water received from a surrounding floor area, the conduit further comprising:

tube (7) means for removing water leaking from the pipe and removing it to a shaft, fitted in the opening of the insert and a pipe (6), inside and concentric with the tube;

(D) connecting means (18) for connecting the gutter member to the conduit and the insert;

(E) draining means (13, 14) for draining water that flows down into the gutter member into the pipe; and (F) sealing means (23, 24, 25) for preventing water from seeping between the floor covering and the gutter member, the sealing means bearing against an upper surface of the floor covering around the upper opening of the gutter member.

2. The device according to claim 1, wherein the connecting means is disposed within a space.

3. The device according to claim 1, wherein the connecting means (18) comprises members (27, 28) for urging said sealing means (23, 24, 25) by force towards the floor covering (8).

4. The device according to claim 3, wherein the sealing means comprises a ring (18) adapted to surround said upper opening (32) and to receive therebelow a section (9) of the floor covering located nearest to the upper opening, wherein the thickness of the ring (18) tapers radially outward to an outer point section (23) including a generally radially directed point, and wherein the sealing means comprises an outer point section of the ring.

5. The device according to claim 3, wherein the sealing means comprises a ring (18) including means to surround said upper opening (32) and receive therebelow a section (9) of the floor covering located nearest to the upper opening, wherein the sealing means comprises surrounding sealing members (24, 25) arranged on a bottom side of the ring, and wherein said urging members (27, 28) are arranged to act upon said sealing members by forcing the ring (18) downwards.

6. The device according to claim 5, wherein the sealing members (24, 25) comprise elastic compressible material.

7. The device according to claim 6, wherein the sealing member comprises at least one conventional O-ring.

8. The device according to claim 4 wherein the ring (18) and the gutter member (11) are separate parts, and wherein the sealing means comprises second sealing means (26) including means to form a surrounding seal between the ring (18) and the gutter member (11) to prevent water from passing.

9. The device according to claim 3, wherein the sealing means comprises a ring (18) adapted to surround said upper opening (32) and receive therebelow sections (9) of the floor covering located nearest to the upper opening, and wherein said urging member (27, 28) includes means to generate a generally vertically downwards force on the ring.

10. The device according to claim 9, wherein the ring (18) includes a section (22) which extends axially into said hole in the floor when the ring is applied into said upper opening (32) and wherein the side wall (5) includes first engagement members (27) and second engagement members disposed on said section extending axially of the rings, the first engagement members and the second engagement members including means to be brought into engagement with each other so as to hold the ring in relation to the side wall in a floor position that forces said sealing means (23, 24, 35) towards the floor covering (8) whereby the first engagement members and the second engagement members comprise the means to generate the downward force on the ring.

11. The device according to claim 9 wherein, in the engagement generating position, a disposition of the first engagement member (27) and the second engagement member (28) comprise means to permit the ring (18) to be turned in relation to the side wall (5) while maintaining engagement, and wherein during turning the engagement members are disposed to run in each other along a path that leads to an axial movement of the ring, in correspondence to a direction of the turning, selectively down into and up from the hole to obtain and leave the forcing position, respectively.

12. The device according to claim 11, wherein the first engagement member (27) extends like an inner thread over at least a part of the circumference of the side wall (5) and wherein the second engagement member (28) extends like an outer thread over at least a part of a generally radially directed surface of the axial section (22).

13. The device according to claim 10, wherein the section (22) of the ring includes third engagement members (29) and means to be brought into engagement with fourth engagement members (30) disposed on an outer wall of the gutter member comprising means to assist in holding the gutter member (11) in place in relation to the side wall (5) of the hole.

14. The device according to claim 1, including conical surface means for the insert to be applied in the hole in the floor where the floor covering (8), at an utmost thereof, extends there over to a region (31) of the upper edge of the side wall (5).

15. The device according to claim 1, wherein the insert opens upwardly through a surrounding section (10) connected to the side wall and extends radially outward making a surrounding section angle with the horizontal, and the floor covering (8) associated therewith makes a larger angle with the horizontal than does the surrounding section.

16. The device according to claim 15, wherein the surrounding section angle with a horizontal plane is acute and corresponds generally to an outer point angle of the ring, and wherein a disposition of the surrounding section comprises means to receive the outer point section (23) of the ring, said point section bearing on said surrounding section through said floor covering.

17. The device according to claim 1, wherein the gutter member (11) is releasably connectable to said conduit (6).

18. The device according to claim 1, wherein a bottom (3) of the insert includes drain hole (4) means for indicating leakages between the gutter member (11) and the insert (1) and, thereby indirectly also between the gutter member and said floor covering (8), by draining water that comes into the space (12) through the drain hole.

19. A method for draining a hole in a floor (2) having a floor covering (8), comprising:

providing a waterproof and water-containing insert (1), the insert including an opening in a side wall (5) thereof;

fixing the insert relative to the floor in the hole;

providing a waterproof and water-containing gutter member (11) having an upper opening and lateral and depth dimensions smaller than an interior of the insert;

providing a conduit disposed to drain from the insert water received from a surrounding floor area, the conduit further comprising:

a tube (7), fitted in the opening of the insert and a pipe (6), inside and concentric with the tube;

connecting the gutter member to the conduit and the insert;

draining water that flows down into the gutter member into the pipe; and preventing water from seeping between the floor covering and the gutter member by bearing against an upper surface of the floor covering around the upper opening of the gutter member.

20. The method according to claim 19, including a step of removing water leaking from the pipe and removing it to a shaft.

21. The method according to claim 19, including a step of making the hole in the floor covering (8) during a time when heating, water and sanitation connections are arranged in the room for wet conditions.

22. The method according to claim 19, including a step of removably arranging the gutter member (11) in the insert (1) in case of inspection or change.

* * * * *